US006773274B2

(12) United States Patent
Tripod

(10) Patent No.: US 6,773,274 B2
(45) Date of Patent: Aug. 10, 2004

(54) MOUNTING ARRANGEMENT FOR CRT SOCKET BOARD

(75) Inventor: Luc Tripod, Zurich (CH)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 09/940,949

(22) Filed: Aug. 28, 2001

(65) Prior Publication Data

US 2003/0045174 A1 Mar. 6, 2003

(51) Int. Cl.[7] ..... H01R 12/00
(52) U.S. Cl. ..... 439/81; 439/699.2
(58) Field of Search ..... 439/81, 699.1, 439/699.2; 348/836, 825

(56) References Cited

U.S. PATENT DOCUMENTS 2,974,192 A * 3/1961 Marholz ..... 348/825
3,944,892 A * 3/1976 Johnson et al. ..... 348/825
4,165,143 A * 8/1979 Puhak ..... 439/366
4,338,635 A * 7/1982 Haider et al. ..... 348/836
4,366,415 A * 12/1982 Takenaka et al. ..... 313/457
4,590,540 A * 5/1986 Nicholson et al. ..... 348/836
4,873,578 A * 10/1989 Tognoni et al. ..... 348/825
5,045,974 A * 9/1991 Ohkoshi et al. ..... 340/815.4
5,202,615 A * 4/1993 An ..... 313/456
5,963,275 A * 10/1999 Cho ..... 348/836

OTHER PUBLICATIONS

The American Heritage Dictionary of the English Language, Third Edition copyright 1992 by Houghton Mifflin Company. Electronic version licensed from INSO Corporation.*

* cited by examiner

*Primary Examiner*—Tho D. Ta
*Assistant Examiner*—James R. Harvey
(74) *Attorney, Agent, or Firm*—Joseph S. Tripoli; Joseph J. Laks; Carlos M. Herrera

(57) ABSTRACT

A socket for a cathode ray tube (CRT) forms part of a circuit board. The socket is positioned on the side of the circuit board away from the funnel portion of the CRT. The terminals which couple to the electron gun of the CRT are positioned along the side of the neck of the CRT, so that when the socket is engaged with the CRT, there is substantially no portion of the socket board which protrudes beyond the end of the neck portion of the CRT.

10 Claims, 1 Drawing Sheet

MOUNTING ARRANGEMENT FOR CRT SOCKET BOARD

This invention relates to a socket for a cathode ray tube (CRT) in which the socket is part of a printed circuit board.

BACKGROUND OF THE INVENTION

In modern television display apparatus, a socket for the electron gun of a CRT is constructed as part of a printed circuit board which may contain one or more video output amplifiers. This is done in order to keep the connections, between the outputs of the video amplifiers and the electrodes of the electron gun, as short as possible so as to avoid degradation of the video output signals, whose frequencies may exceed 5 megahertz. Generally, the socket for the CRT is mounted on the circuit board, so that when the socket is engaged with the CRT, the circuit board is positioned at the rear of the CRT with the socket. The trend in modern CRT displays is to shorten the distance from the screen end of the cabinet to the rear of the cabinet. This can be accomplished in several ways. For example, a greater deflection angle will shorten the funnel portion of the CRT. At the present time, the largest deflection angle in commercial television apparatus is 1100.

SUMMARY OF THE INVENTION

The instant invention allows further shortening of the cabinet by shortening the protrusion of the CRT socket board beyond the end of the neck portion of the CRT. The invention provides an arrangement for coupling a CRT to a socket which is mounted on a circuit board, in which the CRT has a funnel portion and a neck portion containing an electron gun. The terminals for the electron gun are mounted along the side of the neck portion of the CRT. The circuit board is positioned with a first side which faces the funnel portion and a second side which faces away from the funnel portion. The socket has terminals which engage corresponding terminals on the neck portion of the CRT. The socket terminals are positioned on the second side of the circuit board. In this way, the socket and circuit board may be positioned with only a minimum protrusion to the rear of the end of the neck portion of the CRT.

BRIEF DESCRIPTION OF THE DRAWING

In the Drawing:

The sole FIGURE shows an exploded view of a socket board and the rear portion of a CRT.

DETAILED DESCRIPTION

Figure 1:
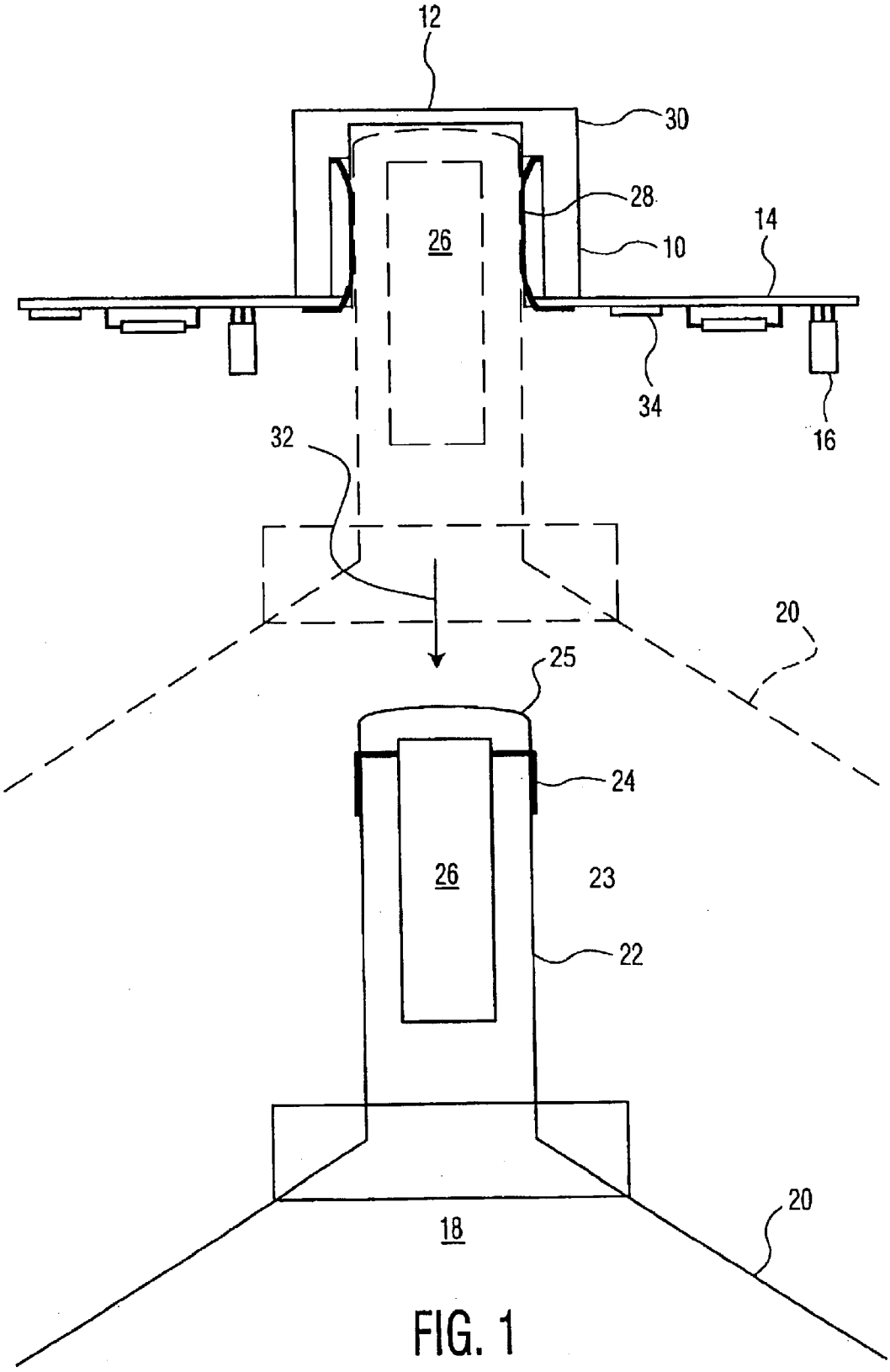

The sole FIGURE shows a cathode ray tube (CRT) 18 having a funnel 20 and a neck 22 which contains an electron gun 26. Terminals 24, which connect to the electron gun 26, are fed through a side of the neck 22 and lie along a circumferential surface 23 of the neck 22. The invention is equally applicable to a CRT whose gun terminals exit through an end 25 of the neck 22 and are folded forward along the circumferential surface 23 of the neck 22. Socket board 34 has electronic components 16 mounted thereon together with CRT socket 10, which contains electrical contacts 28. The electrical contacts 28 serve as terminals to connect to the terminals 24. The electronic components 16 may be mounted on either side of the socket board 34, as long as no electronic components 16 extends away from the funnel 20 of the CRT 18 further than a distal end 30 of the socket 10. The socket 10 is mounted on a side 14 of the socket board 34 facing away from the funnel 20 of the CRT 18. When the socket 10 is engaged with the neck 22 mating the parts in the direction shown by arrow 32, there is substantially no protrusion of any portion of the socket board 34 beyond the end 25 of the neck 22. The socket 10 is provided with a surface on a back portion 12 of the socket 10 which abuts the end 25 of the neck 22, and assists in properly positioning the electrical contacts 28 with respect to the terminals 24. The Applicant has found that the use of the invention may reduce the depth of the cabinet by three to four centimeters.

What is claimed is:

1. A cathode ray tube having a socket which is mounted on a circuit board, comprising:

said cathode ray tube having an integral funnel and a neck containing an electron gun, the neck having an end, a circumferential surface and terminals extending from said electron gun, said terminals positioned along the circumferential surface of the neck, said terminals exit through an end of said neck and are folded along the circumferential surface of said neck, said circuit board being positioned with a first side facing said funnel portion and a second side facing away from said funnel portion, said socket having electrical contacts which physically engage the terminals on said second side of said circuit board, said electrical contacts being positioned on said second side of said circuit board.

2. The cathode ray tube of claim 1, in which said circuit board has a plurality of components mounted on said first side.

3. The cathode ray tube of claim 1, in which said socket has a surface on a back portion of the socket which abuts the end of said neck.

4. The cathode ray tube of claim 3, in which said circuit board has a plurality of components mounted thereon, none of said components extending away from said funnel further than the surface on the back portion of said socket.

5. The cathode ray tube of claim 1, in which said socket has a surface on a back portion of the socket which positions the electrical contacts with respect to the terminals.

6. A cathode ray tube having a socket which is mounted on a circuit board, comprising:

said cathode ray tube having an integral funnel and a neck containing an electron gun, the neck having an end, a circumferential surface and terminals extending from said electron gun, said terminals positioned along the circumferential surface of the neck, said terminals are fed through the circumferential surface of said neck and are folded along the circumferential surface of said neck, said circuit board being positioned with a first side facing said funnel portion and a second side facing away from said funnel portion, said socket having electrical contacts which physically engage the terminals on said second side of said circuit board, said electrical contacts being positioned on said second side of said circuit board.

7. The cathode ray tube of claim 6, which said socket has a surface on a back portion of the socket which abuts the end of said neck.

8. The cathode ray tube of claim 7, in which said circuit board has a plurality of components mounted thereon, none of said components extending away from said funnel further than the surface on the back portion of said socket.

9. The cathode ray tube of claim 6, in which said circuit board has a plurality of components mounted on said first side.

10. The cathode ray tube of claim 6, in which said socket has a surface on a back portion of the socket which positions the electrical contacts with respect to the terminals.

* * * * *